US005286171A

United States Patent [19]

Murota et al.

[11] Patent Number: 5,286,171

[45] Date of Patent: Feb. 15, 1994

[54] METHOD FOR CONTROLLING ENGINE FOR DRIVING HYDRAULIC PUMP TO OPERATE HYDRAULIC ACTUATOR FOR CONSTRUCTION EQUIPMENT

[75] Inventors: Isao Murota; Naoyuki Moriya; Kazuhito Nakai, all of Tokyo, Japan

[73] Assignee: Shin Caterpillar Mitsubishi Ltd., Tokyo, Japan

[21] Appl. No.: 848,176

[22] Filed: Mar. 10, 1992

[30] Foreign Application Priority Data

Nov. 13, 1991 [JP] Japan ..... 03-297393

[51] Int. Cl.[5] ..... F04B 49/00

[52] U.S. Cl. ..... 417/34; 417/42; 417/53

[58] Field of Search ..... 417/34, 42, 53, 222.1

[56] References Cited

U.S. PATENT DOCUMENTS

| | | | |
|---|---|---|---|
| 3,982,508 | 9/1976 | Norlin et al. . | |
| 4,534,707 | 8/1985 | Mitchell | 417/34 |
| 4,549,400 | 10/1985 | King | 417/34 |
| 4,588,357 | 5/1986 | McGraw et al. | 417/34 |
| 4,904,161 | 2/1990 | Kamide et al. | 417/34 |
| 5,155,996 | 10/1992 | Tatsumi et al. | 417/34 |

FOREIGN PATENT DOCUMENTS

| | | |
|---|---|---|
| 0073288 | 3/1983 | European Pat. Off. . |
| 0166546 | 1/1986 | European Pat. Off. . |
| 0287670 | 10/1988 | European Pat. Off. . |
| 2645592 | 10/1990 | France . |
| 60-234101 | 11/1985 | Japan . |
| 2184162 | 6/1987 | United Kingdom . |

OTHER PUBLICATIONS

Patent Abstracts of Japan, vol. 14, No. 540 (Nov. 29, 1990).

*Primary Examiner*—Richard A. Bertsch
*Assistant Examiner*—David W. Scheuermann
*Attorney, Agent, or Firm*—Fish & Richardson

[57] ABSTRACT

In a method for controlling an engine for driving a hydraulic pump to supply a pressurized fluid to at least one hydraulic actuator in a construction machinery, a fuel flow supplied to the engine is decreased so that an output rotational speed of the engine is decreased to decrease an excess output of the engine, and the fuel flow is increased to increase the output rotational speed of the engine when a load of the engine for driving the hydraulic pump is more than a first level after the engine output decreasing step.

21 Claims, 12 Drawing Sheets

METHOD FOR CONTROLLING ENGINE FOR DRIVING HYDRAULIC PUMP TO OPERATE HYDRAULIC ACTUATOR FOR CONSTRUCTION EQUIPMENT

BACKGROUND OF THE INVENTION

The present invention relates to a method for controlling an engine for driving a hydraulic pump which generates pressurized fluid to drive a hydraulic actuator for a construction equipment and, more particularly, to a method for controlling an engine wherein the number of revolutions (rotational speed) of the engine is controlled in accordance with operating conditions of a hydraulic pump for a hydraulic actuator used in a construction equipment.

In a conventional method of controlling an engine for driving a hydraulic pump which generates hydraulic pressure to drive hydraulic actuators for construction equipment, as disclosed in the specification and the appended drawings of, for example, Japanese Patent Application No. 55-42840, when it is sensed that an operating lever by which an operator manipulates the hydraulic actuators occupies a position for stopping operations of all the hydraulic actuators over a certain period of time, the number of revolutions of the engine is reduced to less than the revolution number of the engine during normal operation. After the revolution number of the engine is thus reduced, when the operating lever is displaced from the position for stopping the operations of the hydraulic actuator, in order to drive at least one hydraulic actuators, the displacement of the operating lever is sensed so that the revolution number of the engine returns to the revolution number for the normal operation. In this conventional method, the control of the engine revolution number is performed only on the basis of the position of the operating lever handled by the operator.

SUMMARY OF THE INVENTION

An object of the present invention is to provide a method for controlling an engine for driving a hydraulic pump to supply a pressurized fluid to a hydraulic actuator in a construction equipment without an unnecessary output of the engine and an inappropriate output increase or insufficiency of the engine.

According to the present invention, a method for controlling an engine for driving a hydraulic pump to supply a pressurized fluid to a hydraulic actuator in a construction equipment, comprises the steps of:

engine output decreasing step for decreasing a fuel flow supplied to the engine so that an output rotational speed of the engine is decreased to prevent an excess output of the engine, and engine output increasing step for increasing the fuel flow to increase the output rotational speed of the engine when a load of the engine for driving the hydraulic pump is more than a first degree after the engine output decreasing step.

The fuel flow is increased to increase the output rotational speed of the engine when the load of the engine for driving the hydraulic pump is more than the first degree after the output rotational speed of the engine is decreased to prevent the excess output of the engine in the engine output decreasing step. The fuel flow is increased according to an actual condition of the load of the engine so that the inappropriate output increase is securely prevented when the fuel flow is kept small to prevent the unnecessary output of the engine and the inappropriate output in sufficiency of the engine is securely prevented when a large output of the engine is needed to operate the actuator.

DETAILED DESCRIPTION OF THE PREFERRED EMBODIMENTS

Figure 1:
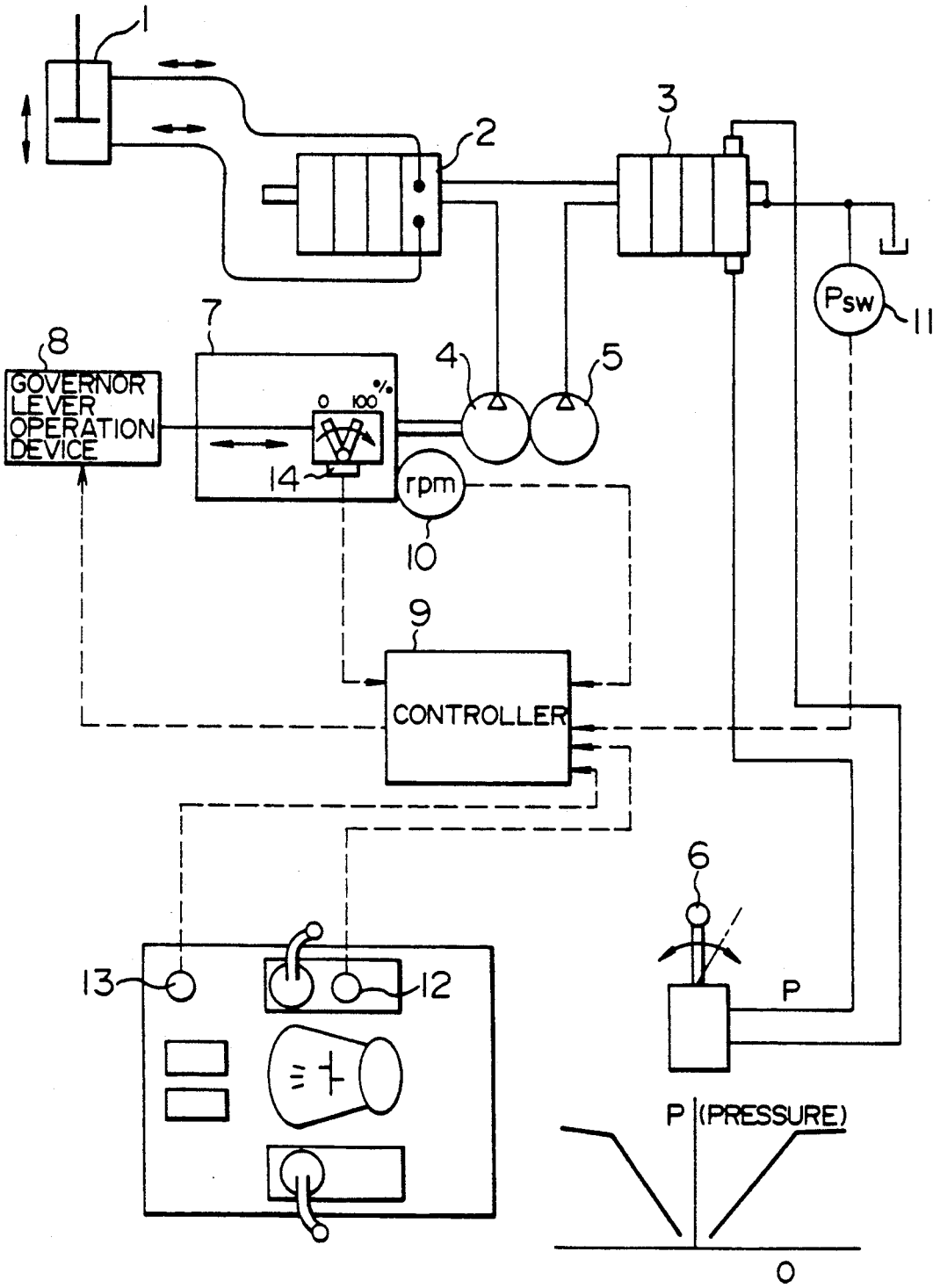
FIG. 1 is a schematic view showing an actuator driving/controlling system in construction equipment to which system one embodiment of the present invention is applied.

FIG. 1 shows an actuator driving/controlling apparatus for a construction equipment to which apparatus the present invention is applied. Though there are normally provided a plurality of actuators 1 in the construction equipment, one of them is shown in FIG. 1, as a matter of convenience for clarifying the invention. An operation of the actuator 1 is controlled by a high-pressure hydraulic valve 2 which controls a flow rate of high hydraulic pressure output from a high-pressure hydraulic pump 4 to the actuator 1 and/or a flow rate of hydraulic pressure from the actuator 1. An operation of the high-pressure hydraulic valve 2 is controlled by low hydraulic pressure which is output from a low pressure hydraulic pump 5 controlled by a pilot valve 3, the output hydraulic pressure from the low pressure hydraulic pump 5 is generally in proportion to an inclination angle $\theta$ of an operation lever 6 with respect to its upright position. Accordingly, the operation of the actuator 1 is controlled, through the pilot valve 3 and the high-pressure hydraulic valve 2, by the operating lever 6 handled by the operator. In general, the actuator 1 is arranged to stop the operation thereof when the inclination angle $\theta$ of the operating lever 6 is zero.

The high-pressure hydraulic pump 4 and the low-pressure hydraulic pump 5 are driven by an engine 7 including a govenor 7 (not shown). The number of revolutions (rotational speed) of the engine 7 is adjusted on the basis of a fuel supplying rate which is controlled by a govenor lever operation device 8 for moving a govenor lever (not shown) of the govenor 7. The supplying rate of the fuel is regulated in accordance with a position of the govenor lever controlled by the govenor lever operation device 8. The position of the govenor lever controlled by the govenor lever operation device 8 is determined by a controller 9, depending on the following factors: an output of a revolution number detector 10 for measuring a output revolution number of the engine 7; an output of a pressure gauge 11 which measures the hydraulic pressure applied to the pilot valve 3 in proportion to the operation inclination angle $\theta$ of the operating lever 6 so as to detect a fact that a command for stopping the operation of the actuator 1 is issued or that a command for operating the actuator 1 is issued; an output of an accel setting device 12 for setting a predetermined revolution number of the engine 7 (a revolution number of the engine 7 desirable when the engine rotates without a reduced fuel supplying rate caused by a speed-reduction command according to the invention and with no load, in other words, a revolution number which serves as a reference desired for the engine 7 under the condition with no load, before the fuel supplying rate is decreased or when it is not decreased, in accordance with a condition of the engine load or a state of an actuator operating command); and an output from an AEC setting device for commanding a AEC (automatic engine revolution number adjusting control) operation at a primary stage in which a decreasing degree of the engine revolution number in response to the condition of the engine or the engine condition command is small and at a secondary stage in which the decreasing degree of the engine revolution number in response to the condition of the engine or the engine condition command is large. The load of the engine 7 for driving the hydraulic pumps 4 and 5 is measured from a difference between an actual output rotational speed of the engine 7 obtained when the load is measured and an output rotational speed of the engine 7 which is obtainable when the fuel flow supplied to the engine 7 when the load is measured is supplied to the engine 7 when an action of the actuator 1 is stopped.

A method of controlling the revolution number (rotational speed) of the engine 7 by the fuel control by means of the controller 9 via the govenor lever operation device 8 and the govenor lever, according to the present invention, will be described hereinafter.

Concrete examples of various kinds of set values used in one embodiment of the invention, will be listed below.

| | |
|---|---|
| Predetermined Revolution Number: | $A_{CCEL}$ = A desired revolution speed of the engine with no load at each accel position |
| Command Value of Middle-speed Operation: | $N_{M1} = A_{CCEL} - 100$ rpm (at the AEC I stage)<br>$N_{M2} = A_{CCEL} - 100$ rpm (at the AEC II stage) |
| Command Value of Low-speed Operation: | $N_{L1}$ = ACCEL − 100 rpm (at the AEC I stage)<br>$N_{L2}$ − 1300 rpm (at the AEC II stage) |
| Light-load Judging Revolution Number: | $N_{11}$ = Na − 10 rpm (at the AEC I stage)<br>$N_{21}$ = Na − 10 rpm (at the AEC II stage) |
| Middle-load Judging Revolution Number: | $N_{12}$ = Na − 50 rpm (at AEC I stage)<br>$N_{22}$ = Na − 50 rpm (at the AEC II stage) |
| Heavy-load Judging Revolution Number | |
| Judging Revolution Number for Returning During Low-Speed Operation: | $N_{13}$ = Na rpm 70 rpm (at the AEC I stage)<br>$N_{23}$ = Na rpm 70 rpm (at the AEC II stage) |
| Judging Revolution Number for Returning During Middle-Speed Operation: | $N_{14}$ = Na rpm 70 rpm (at the AEC I stage)<br>$N_{24}$ = Na rpm 70 rpm (at the AEC II stage) |
| No-load Revolution Number at Each Governor Lever Position: | Na (This number changes in accordance with each governor lever position.) |

[Na is the number of revolutions of the engine, at a speed higher than which number of revolutions the engine rotates when a rate of fuel in response to the position of the govenor lever is supplied to the engine from the govenor in the case where the engine revolves with no load (the actuator is not operated). The value of Na is calculated on the basis of a predetermined relation between the govenor lever position and the no-load revolution number Na, in accordance with the govenor operated position measured by the govenor lever position detector 14, when measuring the load.]

| | |
|---|---|
| Light-load Judging Time: | $T_{1A}$ = 3 seconds (at the AEC I stage)<br>$T_{2A}$ = 3 seconds (at the AEC II stage) |
| Middle-load Judging Time: | $T_{1B}$ = 10 seconds (at the AEC I stage)<br>($T_{2B}$ = 10 seconds (at the AEC II stage) |

Next, there will be described a relation between a load condition of the engine and the engine controlling method on selection of the AEC I stage, in the case where the various kinds of values are set in the above-mentioned manner. A selected condition is full-accel position ($A_{ccel}$=2000 rpm) as a position of the accel. When the AEC II stage is selected, each set value is exchanged and a relation indicated below is applied. Portions represented by alphabets correspond to steps in flowcharts of FIGS. 2A, 2B, 3, 4A, 4B and 5.

1. A relation between the load condition and the engine controlling method on issue of the low speed operation 1) The load condition occurring when the engine is brought into the light-load condition from the heavy-load condition and the engine controlling method

TABLE 1

| | | |
|---|---|---|
| FLOW | (i) | START → A → B → C → D → E → F → J → K → O → P → START |
| | (ii) | START → A → B → C → D → E → F → G → H → K → L → M → P → START |
| | (iii) | START → A → B → C → D → E → F → G → H → I → START |
| | (iv) | START → A → B → C → D → Q → R → S → T → I → START |
| | (v) | START → A → B → C → D → E → Q → R → S → I → START |

(i) Heavy-load condition

Now, in a condition of the govenor lever for supplying fuel in order to perform a predetermined rotation operation (the full-accel operation), the engine actually rotates in the heavy-load condition with the number Ne of revolutions of 1800 rpm. First, various kinds of input signals are processed through the A step and each predetermined value is set as follows.

AEC SW = I stage

-continued

| |
|---|
| $A_{CCEL}$ = 2000 rpm |
| Ne = 1800 rpm |
| Na = $A_{CCEL}$ = 2000 rpm |

Because the AEC I stage is selected, a FLOW proceeds from A to B, C and D where the respective values are predetermined in the following manner.

| |
|---|
| $N_{11}$ = Na − 10 rpm = $A_{CCEL}$ − 10 rpm = 1990 rpm |
| $N_{12}$ = Na − 50 rpm = $A_{CCEL}$ − 50 rpm = 1950 rpm |
| $N_{13}$ = Na − 70 rpm = $A_{CCEL}$ − 70 rpm = 1930 rpm |
| $N_{14}$ = Na − 70 rpm = $A_{CCEL}$ − 70 rpm = 1930 rpm |

The FLOW branches to YES at the operating condition judging step E because the engine is desired to rotate with the predetermined revolution number $A_{CCEL}$. At the light-load judging step F, the true ($Ne > N_{11}$) is not achieved because Ne, which is 1800 rpm, is smaller than $N_{11}$, which is 1990 rpm, so that the FLOW branches to NO. A light-load elapsed time measuring counter is cleared at the J step and $T_{11}$ becomes zero. Further, at the middle-load judging step K, $Ne > N_{12}$ is not achieved because Ne, which is 1800 rpm, is smaller than $N_{12}$, which is 1950 rpm, and the FLOW branches to NO. A middle-load elapsed time measuring counter at 0 is cleared so that $T_{12}$ becomes zero. In this FLOW, the operation reaches the predetermined rotation operation command step P so as to achieve the desired predetermined operation as indicated by the accel. The FLOW returns to START again.

(ii) Light-load transition condition (before the number of revolutions of the engine is lowered after the load of the engine becomes small)

Here, the engine load condition changes from the heavy-load condition into the light-load condition. A no-load neutral condition is supposed as the light load. An actual number of the engine revolutions changes from 1800 rpm to 2000 rpm (the revolution number of the engine rotating with no load). The FLOW proceeds from A to B, C and D successively. Because the govenor lever has been retained at the predetermined position yet, Na is equal to $A_{CCEL}$ which is 2000 rpm at A. Therefore, the values of $N_{11}$, $N_{12}$, $N_{13}$, and $N_{14}$ are not changed, respectively, at D and the values in the FLOW (i) are maintained.

Under the condition of the predetermined operation at E, the FLOW branches to YES, similar to the foregoing FLOW. The direction of the FLOW changes at the light-load judging step F. That is to say, since Ne which is 2000 rpm is larger than $N_{11}$ which is 1990 rpm, $Ne > N_{11}$ is achieved and the FLOW branches to YES.

A light-load elapsed time measuring counter at G counts up so that $T_{12}$ becomes 0.02 seconds if one count corresponds to 0.02 seconds. At the light-load elapsed time judging step H, $T_{11}$ which is 0.02 seconds is smaller than $T_{1A}$ which is 3 seconds, and consequently, $T_{11} > T_{1A}$ is not achieved and the FLOW branches to NO.

At the middle-load judging step K, because Ne which is 2000 rpm is larger than $N_{12}$ which is 1950 rpm, the FLOW branches to YES.

A middle-load elapsed time measuring counter at L counts up so that $T_{12}$ becomes 0.02 seconds from 0.

At the middle-load elapsed time judging step M, $T_{12}$ which is 0.02 seconds is smaller than $T_{1B}$ which is 10 seconds, and therefore, $T_{12} > T_{1B}$ is not achieved. The FLOW reaches P after it branches to NO. The predetermined rotation (accel command) operation is still directed and the AEC has not been operated yet. (iii) Start of the low-speed operation command under the light-load (neutral) condition (when a period of time during which the engine load is small exceeds a certain limit and the revolution number of the engine has begun to be lowered)

When the FLOW of the above paragraph (ii) is generated continuously for 151 cycles, the low-speed operation command is started.

This FLOW advances from A to B, C, D, E and up to F, similarly to the FLOW of the paragraph (ii). At the time of the 151 cycle, the light-load elapsed time measuring counter G counts up SO that $T_{11}$ indicates 3.02 seconds.

At the light-load elapsed time judging step H, because $T_{11}$ is 3.02 seconds and $T_{1A}$ is 3 seconds and since $T_{11}$ is larger than $T_{1A}$, $T_{11} > T_{1A}$ is achieved, and the FLOW branches to YES. As a result, he low-speed Operation is commanded for the first time at I. (In addition, the value of the middle-load elapsed time achieved at the last 150th cycle is maintained so that $T_{12}$ is 3.00 seconds.)

(iv) During transition to the position of the low-speed operation under the light-load (neutral) condition (in the process of lowering the revolution number of the engine)

Here will be described such condition that the govenor lever receives the low-speed operation command issued at the last FLOW (iii) firstly so as to move to the low-speed position by means of the govenor lever operation device. As a concrete example, there is shown a FLOW after the govenor lever is driven to the intermediate position between the predetermined speed and the flow speed. First, at A, the value of Na is changed differently from that of the above paragraph (iii), because the govenor lever is moved. As a matter of convenience for explanation, if a relation between the position of the govenor lever and Na (the no-load revolving speed) is linear, $N = (A_{CCEL} + N_{LI})/2 = (2000 + 1900)/2 = 1950$ rpm because the govenor lever is moved to the intermediate position thereof. (Note: Since the relation is not always linear due to the govenor and engine characteristics in actual cases, the no-load revolution number Na may be calculated through a previously memorized function.) It is supposed that the actual engine revolution number Ne under the no-load condition is 1950 rpm. In this way, after Na is renewed, the FLOW proceeds from B to C and D, and the respective values are renewed by the load judging revolution number setting step D as follows.

| |
|---|
| $N_{11}$ = Na − 10 rpm = $A_{CCEL}$ − 10 rpm = 1940 rpm |
| $N_{12}$ = Na − 50 rpm = $A_{CCEL}$ − 50 rpm = 1900 rpm |
| $N_{13}$ = Na − 70 rpm = $A_{CCEL}$ − 70 rpm = 1880 rpm |
| $N_{14}$ = Na − 70 rpm = $A_{CCEL}$ − 70 rpm = 1880 rpm |

Now, because the low-speed operation is being commanded, the FLOW branches to NO at the operating condition judging step E, and then, the FLOW branches to YES at the adjoining step Q.

Because Ne is 1950 rpm and $N_{13}$ is 1880 rpm and Ne is larger than $N_{13}$ at the heavy-load judging step R, $Ne < N_{13}$ is not achieved and the FLOW branches to NO. The FLOW branches to YES because it is measured by the operating condition judging step S that the govenor lever is being displaced toward the low speed position thereof. Further, at the light-load judging step T, since Ne is 1950 rpm and $N_{11}$ is 1940 rpm and Ne is larger than $N_{11}$, $Ne < N_{11}$ is achieved, the FLOW branches to YES so that the low-speed operation command in which the govenor lever is moved to the low speed position gradually is continued at I.

(v) The low-speed operation under the light-load (neutral) condition (when the low-speed operation revolution number of the engine is maintained within a desired range)

The FLOW under such condition that the govenor lever finally has reached the low-speed operation position will be shown. Incidentally, Ne is 1900 rpm.

Under such operating condition, the value of Na at A is as follows.

$$Na = N_{L1} = A_{CCEL} - 100 \text{ rpm} = 2000 \text{ rpm} - 100 \text{ rpm} = 1900 \text{ rpm}$$

More specifically, Na becomes the low-speed operation revolution number, and the FLOW advances from B to C and D. The respective values are renewed at the load judging revolution number setting step D in the following manner.

$$N_{11} = Na - 10 \text{ rpm} = 1900 \text{ rpm} - 10 \text{ rpm} = 1890 \text{ rpm}$$
$$N_{12} = Na - 50 \text{ rpm} = 1900 \text{ rpm} - 50 \text{ rpm} = 1850 \text{ rpm}$$
$$N_{13} = Na - 70 \text{ rpm} = 1900 \text{ rpm} - 70 \text{ rpm} = 1830 \text{ rpm}$$
$$N_{14} = Na - 70 \text{ rpm} = 1900 \text{ rpm} - 70 \text{ rpm} = 1830 \text{ rpm}$$

Because the low-speed operation is being commanded at present, the FLOW branches to NO at the operating condition judging step E, and it then branches to YES at the subsequent Q step.

Since Ne is 1900 rpm and $N_{13}$ is 1830 rpm and Ne is larger than $N_{13}$ at the heavy-load judging step R, $Ne < N_{13}$ is not achieved and the FLOW branches to NO. The low-speed operation is performed so that the FLOW branches to NO at the operating condition judging step S and directly leads to I. Thus, the low-speed operation is continued under the no-load condition.

2) Charging of a heavy load during the low-speed operation with no load (when the heavy load is applied to the engine which operates at low speed with continuation of the no-load condition)

| | |
|---|---|
| FLOW (v) | START → A → B → C → D → E → Q → R → S → I → START |
| FLOW (vi) | START → A → B → C → D → E → Q → R → P → START |

(v) During the low-speed operation with no load (when a rate of fuel which is enough to perform the low-speed operation at a generally desired low revolving speed, is being applied to the engine)

It is assumed that the above-mentioned low-speed operation with no load is continued.

The FLOW is quite similar to the FLOW (v) of the paragraph 1. -1). The respective constants and variables are as follows.

AEC SW = I stage
$A_{CCEL}$ = 2000 rpm
Ne = 1900 rpm
$Na = L_{L1}$ = 1900 rpm
$N_{11} = Na - 10 \text{ rpm} = 1900 \text{ rpm} - 10 \text{ rpm} = 1890 \text{ rpm}$
$N_{12} = Na - 50 \text{ rpm} = 1900 \text{ rpm} - 50 \text{ rpm} = 1850 \text{ rpm}$
$N_{13} = Na - 70 \text{ rpm} = 1900 \text{ rpm} - 70 \text{ rpm} = 1830 \text{ rpm}$
$N_{14} = Na - 70 \text{ rpm} = 1900 \text{ rpm} - 70 \text{ rpm} = 1830 \text{ rpm}$
$T_{11}$ = 3.02 seconds
$T_{12}$ = 3.00 seconds (vi) Charging of the heavy load (when the heavy load is applied to the engine at the time of supplying to the engine a rate of fuel which is enough to perform the low-speed operation)

When such heavy load that the revolution number Ne of the engine is made 1750 rpm is applied in the last FLOW (v) (during the low-speed operation with no load), the govenor lever has been at the low-speed operation position yet. Therefore, the respective values are determined at A as follows.

AEC SW = I stage
$A_{CCEL}$ = 2000 rpm
Ne = 1750 rpm
$Na = N_{L1}$ = 1900 rpm

Subsequently, the FLOW advances to B, C and D. The last values are maintained at D.

$$N_{11} = Na - 10 \text{ rpm} = 1900 \text{ rpm} - 10 \text{ rpm} = 1890 \text{ rpm}$$
$$N_{12} = Na - 50 \text{ rpm} = 1900 \text{ rpm} - 50 \text{ rpm} = 1850 \text{ rpm}$$
$$N_{13} = Na - 70 \text{ rpm} = 1900 \text{ rpm} - 70 \text{ rpm} = 1830 \text{ rpm}$$
$$N_{14} = Na - 70 \text{ rpm} = 1900 \text{ rpm} - 70 \text{ rpm} = 1830 \text{ rpm}$$

Because the low-speed operation is being commanded at present, the FLOW branches to NO at the operating condition judging step E and branches to YES at the subsequent Q step, the FLOW then leading to R. At the heavy-load judging step R, Ne is 1750 rpm and $N_{13}$ is 1830 rpm and Ne is smaller than $N_{13}$ so that the true ($Ne < N_{13}$) is achieved. As a result, the FLOW branches to YES.

If the heavy load is detected, the FLOW gets to P without delay and the predetermined operation is immediately commanded.

After commanding the predetermined rotating operation, this FLOW becomes similar to the FLOW (i) at the above-mentioned time when the heavy load is supplied. However, the values of both Ne and Na are renewed every time until the govenor lever is returned to the position of the predetermined rotation. $N_{11}$, $N_{12}$, $N_{13}$ and $N_{14}$ are also renewed, respectively, in response to the renewal of Na, and the load judging conditions in F and K are renewed.

Meanwhile, the values of the light and middle load elapsed times $T_{11}$ and $T_{12}$, which have been maintained on the last occasion, are cleared to zero as follows, at the point of time when the FLOW passes J and O for the first time so that when the operation is performed under the light or middle load condition, the counters can start to count up from zero seconds.

| |
|---|
| $T_{11}$ = 3.02 seconds → 0 seconds |
| $T_{12}$ = 3.00 seconds → 0 seconds |

3) Charging the middle load during transition to the low-speed operation (retaining movement) (when the middle load which is larger than the light load but is smaller than the heavy load is applied in the process of decreasing the revolution number of the engine while the engine load is so small that the no-load condition is continued)

| | | |
|---|---|---|
| FLOW | (iv) | START → A → B → C → D → E → Q → R → S → T → I → START |
| | (vii) | START → A → B → C → D → E → Q → R → S → T → U → START |

(iv) During transition to the position of the low-speed operation under the light-load (neutral) condition (as one example of state in the process of lowering the revolution number of the engine, in the case where the engine revolution number is between the predetermined revolution number and the low-speed operation commanding value)

Here, the FLOW proceeds quite similarly to the above-described FLOW 1. - 1) - (iv). In other words, the govenor lever is also at the intermediate position between the predetermined speed position and the low-speed position. Accordingly, Ne is 1950 rpm and Na is 1950 rpm. The values of Ne and Na at D are also the same.

| |
|---|
| $N_{11}$ = Na − 10 rpm = 1950 rpm − 10 rpm = 1940 rpm |
| $N_{12}$ = Na − 50 rpm = 1950 rpm − 50 rpm = 1900 rpm |
| $N_{13}$ = Na − 70 rpm = 1950 rpm − 70 rpm = 1880 rpm |
| $N_{14}$ = Na − 70 rpm = 1950 rpm − 70 rpm = 1880 rpm |

(vii) Charging of the middle load (when the middle load which is larger than the light load but smaller than the heavy load is applied under the above-mentioned condition)

It is supposed that the middle load is charged in the last FLOW (iv) (during the transition to the position of the low-speed operation) such that the engine revolution number Ne is smaller than $N_{11}$ and larger than $N_{13}$.

Approximately 1920 rpm is obtained as a value of the engine revolution number Ne.

The respective values at the input processing unit A are set as follows.

| |
|---|
| AEC SW = I stage |
| $A_{CCEL}$ = 2000 rpm |
| Ne = 1920 rpm |
| Na = $A_{CCEL}$ = 1950 rpm |

Subsequently, the FLOW advances to B, C and D. The values of the last paragraph (iv) are maintained at D.

Because the low-speed operation is being commanded at present, the FLOW branches to NO at the operating condition judging step E and branches to YES at the subsequent Q step, the FLOW then leading to R. At the heavy-load judging step R, Ne is 1920 rpm and $N_{13}$ is 1880 rpm and Ne is larger than $N_{13}$ so that the true ($Ne < N_{13}$) is not achieved. As a result, the FLOW branches to No.

At the operating condition judging step S, the FLOW branches to YES because the operation is being changed to the low-speed operation. Further, at the light-load judging step T, because Ne is 1920 rpm and $N_{11}$ is 1940 rpm and Ne is smaller than $N_{11}$, $Ne < N_{11}$ is not achieved so that the FLOW branches to NO, arriving at the operating condition command step U. As a result, a command for retaining the present position of the govenor lever is issued.

If the operation is brought into the no-load condition again after this middle-load condition (that is, the retained condition) is continued for a little (for example, the engine revolution number Ne which has been 1920 rpm returns to 1950 rpm), the FLOW becomes similar to the FLOW (iv). At the light-load judging step T, Ne which is 1950 rpm is larger than $N_{11}$ which is 1940 rpm, and accordingly, $Ne < N_{11}$ is achieved. The operation command changes from the condition retaining command to the low-speed operation command I without delay so that the govenor lever is moved to the position of the low-speed operation.

A supplementary explanation concerning the retaining function will be given here. The light-load judging step T acts to branch the operation command into the following two commands in association with the load judgement at the previous heavy-load judging step R.

| | |
|---|---|
| (a) $Ne > N_{11}$ | (the light load condition) ⟶ a command for performing the low-speed operation |
| (b) $N_{11} > Ne > N_{13}$ | (the intermediate condition between the heavy and light load conditions) ⟶ a command for retaining the present position |

More specifically, in view of operatability of a hydraulic shovel, because a certain load is charged though the load is not so heavy that the engine revolution number should return to the predetermined revolution number (high speed), the present position of the govenor lever is retained without reducing the revolving speed to be low.

2. A relation between the load condition and the engine controlling method on issue of the middle-speed operation command 1) The load condition achieved when the engine is brought into the middle-load condition from the heavy-load condition and the engine controlling method

TABLE 2

| | | |
|---|---|---|
| FLOW | (i) | START → A → B → C → D → E → F → J → K → 0 → P → START |
| | (ii) | START → A → B → C → D → E → F → J → K → L → M → P → START |
| | (iii) | START → A → B → C → D → E → F → J → K → L → M → N → START |
| | (iv) | START → A → B → C → D → E → Q → V → W → X → N → START |
| | (v) | START → A → B → C → D → E → Q → V → W → N → START |

(i) Heavy load condition

Similarly to the aforesaid FLOW 1. - 1) (i), the engine operation is under such heavy-load condition that the engine revolution number Ne is about 1800 rpm. The respective values are as follows, similarly to the last FLOW (i), and the predetermined rotation operating command is finally issued from P.

AEC SW = I stage
$A_{CCEL}$ = 2000 rpm
Ne = 1800 rpm
Na = $A_{CCEL}$ = 2000 rpm
$N_{11}$ = Na − 10 rpm = $A_{CCEL}$ − 10 rpm = 1990 rpm
$N_{12}$ = Na − 50 rpm = $A_{CCEL}$ − 50 rpm = 1950 rpm
$N_{13}$ = Na − 70 rpm = $A_{CCEL}$ − 70 rpm = 1930 rpm
$N_{14}$ = Na − 70 rpm = $A_{CCEL}$ − 70 rpm = 1930 rpm
$T_{11}$ = 0 seconds
$T_{12}$ = 0 seconds (ii) Middle-load transition condition (before the number of revolutions of the engine is lowered after the load of the engine becomes small)

Here, the load condition changes from the heavy-load condition to the middle-load condition. About 1970 rpm is selected as a value of the revolution number Ne of the engine rotating with the middle load. The number Ne of the engine revolutions changes from 1800 rpm to 1970 rpm. The FLOW proceeds from A to B, C and D, successively. Because the govenor lever has been retained at the predetermined position, Na is equal to $A_{CCEL}$ which is 2000 rpm at A. Therefore, the values of $N_{11}$, $N_{12}$, $N_{13}$ and $N_{14}$ are not changed, respectively, at D and the values in the FLOW (i) are maintained.

Under the condition of the predetermined operation at E, the FLOW branches to YES, similarly to the foregoing FLOW. The FLOW changes at the light-load judging step F. That is to say, since Ne which is 1970 rpm is smaller than $N_{11}$ which is 1990 rpm, $Ne<N_{11}$ is not achieved and the FLOW branches to NO. In the light-load elapsed time measuring counter step J, although the last value $T_{11}$ is zero, a clearing action is performed.

At the middle-load judging step K, because Ne which is 1970 rpm is larger than $N_{12}$ which is 1950 rpm, the FLOW branches to YES.

A middle-load elapsed time measuring counter at L counts up so that $T_{12}$ becomes 0.02 seconds from 0.

At the middle-load elapsed time judging step M, $T_{12}$ which is 0.02 seconds is smaller than $T_{1B}$ which is 10 seconds, and consequently, $T_{12}<T_{1B}$ is not achieved. The FLOW reaches P after it branches to NO. The predetermined rotation (accel command) operation is still directed and the AEC has not been operated yet.

(iii) Start of the middle-speed operation command under the middle-load condition (when a period of time during which the engine load is small exceeds a certain limit and the number of revolutions of the engine is lowered)

When the above-described FLOW (ii) is continuously generated for 501 cycles, the middle-speed operation command is started.

This FLOW advances from A to B, C, D, E, F, J and up to K, similarly to the aforesaid FLOW (ii). At the time of the 501 cycle, the middle-load elapsed time measuring counter at L counts up so that $T_{12}$ indicates 10.02 seconds. At the middle-load elapsed time judging Step M, because $T_{12}$ which is 10.02 seconds is larger than $T_{1B}$ which is 10 seconds, $T_{12}>T_{1B}$ is achieved, and the FLOW branches to YES. As a result, the middle-speed operation is commanded for the first time at N. (In addition, the value of the light-load elapsed time is cleared to zero so that $T_{11}$ becomes zero seconds.)

(iv) During transition to the position of the low-speed operation under the middle-load condition (in the process of lowering the number of the engine revolutions)

Here will be described such condition that the govenor lever receives the middle-speed operation command issued in the last FLOW (iii) for the first time so as to move to the middle-speed position by means of the govenor lever driving device. As a concrete example, there is shown the FLOW after the govenor lever is urged to the intermediate position between the predetermined speed position and the low speed position. First, at A, the value of Na is changed differently from that of the above FLOW (iii), because the govenor lever is moved.

As a matter of convenience for explanation, if a relation between the position of the govenor lever and Na (the number of revolutions of the engine with no load) is linear, $N=(A_{CCEL}+N_{M1})/2=(2000+1900)/2=1950$ rpm because the govenor lever is at the intermediate position. (Note: Since the relation is not always linear due to the govenor and engine characteristics in actual cases, the no-load revolution number Na may be calculated through a previously memorized function.) It is supposed that the engine revolution number Ne is 1920 rpm.

In this way, after Na is renewed, the FLOW proceeds from B to C and D, and the respective values are renewed by the load judging revolution number setting step D as follows.

$N_{11}$ = Na − 10 rpm = 1950 rpm − 10 rpm = 1940 rpm
$N_{12}$ = Na − 50 rpm = 1950 rpm − 50 rpm = 1900 rpm
$N_{13}$ = Na − 70 rpm = 1950 rpm − 70 rpm = 1880 rpm
$N_{14}$ = Na − 70 rpm = 1950 rpm − 70 rpm = 1880 rpm Now, because the middle-speed operation is being commanded, the FLOW branches to NO at the operating condition judging step E and the FLOW also branches to YES at the adjoining step Q.

At the heavy-load judging step V, Ne which is 1920 rpm is larger than $N_{14}$ which is 1880 rpm, and therefore, $Ne<N_{14}$ is not achieved and the FLOW branches to NO. The FLOW then branches to YES because it is measured at the operating condition judging step W that the govenor lever is being displaced to the middle-speed position. Further, at the middle-load judging step X, since Ne of 1950 rpm is larger than $N_{12}$ of 1940 rpm, $Ne<N_{11}$ is achieved, and the FLOW branches to YES so that the middle-speed operation command (the govenor lever should be moved to the middle speed position) continues to be issued at N.

(v) The middle-speed operation under the middle-load condition (when the number of the middle-speed revolutions of the engine is maintained within a desired range)

The FLOW achieved under such condition that the govenor lever finally reaches the middle-speed operation position, will be shown. Incidentally, Ne is set to be 1870 rpm.

Under this operating condition, the value of Na at A is as follows.

$Na = N_{M1} = A_{CCEL} - 100$ rpm $= 2000$ rpm $- -$ 100 rpm $= 1900$ rpm

More specifically, Na becomes the revolution number of the engine during the middle-speed operation, and the FLOW advances from B to C and D. The respective values are renewed at the load judging revolution number setting step D in the following manner.

$N_{11} = Na - 10$ rpm $= 1900$ rpm $- 10$ rpm $= 1890$ rpm
$N_{12} = Na - 50$ rpm $= 1900$ rpm $- 50$ rpm $= 1850$ rpm
$N_{13} = Na - 70$ rpm $= 1900$ rpm $- 70$ rpm $= 1830$ rpm
$N_{14} = Na - 70$ rpm $= 1900$ rpm $- 70$ rpm $= 1830$ rpm Because the middle-speed operation is being commanded at present, the FLOW branches to NO at the operating condition judging step E and it then branches to NO a the subsequent Q step.

At the heavy-load judging step V, since Ne which is 1870 rpm is larger than $N_{14}$ which is 1830 rpm, $Ne < N_{14}$ is not achieved and the FLOW branches to NO. The middle-speed operation is performed at the operating condition judging step W so that the FLOW branches to NO and directly leads to N.

Thus, the middle-speed operation is continued under the middle-load condition.

2) Charging of the heavy load judging the middle-speed operation with the middle load (when the heavy load is applied to the engine in case of supplying to the engine a rate of fuel for performing the middle-speed operation)

FLOW (v) START → A → B → C → D → E → Q → V → W → N → START
(vi) START → A → B → C → D → E → Q → V → P → START (v) During the middle-speed operation with the middle load (when a rate of fuel which is enough to perform the middle-speed operation with the generally desired number of the middle-speed revolutions, is being applied to the engine)

It is assumed that the above-mentioned middle-speed operating condition with the middle load is continued. The FLOW is quite the same as the FLOW 2. - 1) (v). The respective constants and variables are as follows.

AEC SW = I stage
$A_{CCEL} = 2000$ rpm
Ne = 1870 rpm
$Na = L_{L1} = 1900$ rpm
$N_{11} = Na - 10$ rpm $= 1900$ rpm $- 10$ rpm $= 1890$ rpm
$N_{12} = Na - 50$ rpm $= 1900$ rpm $- 50$ rpm $= 1850$ rpm
$N_{13} = Na - 70$ rpm $= 1900$ rpm $- 70$ rpm $= 1830$ rpm
$N_{14} = Na - 70$ rpm $= 1900$ rpm $- 70$ rpm $= 1830$ rpm
$T_{11} = 10.02$ seconds
$T_{12} = 0.00$ seconds (vi) Charging of the heavy load (when the heavy load is applied to the engine during the middle-speed operation)

Such heavy load that the engine revolution number Ne becomes 1750 rpm is charged in the last FLOW (v) (during the middle-speed operation with the middle load). The govenor lever has been at the middle-speed operation position yet at the time of charging the load. Therefore, the respective values at A are determined as follows.

AEC SW = I stage
$A_{CCEL} = 2000$ rpm
Ne = 1750 rpm
$Na = N_{M1} = 1900$ rpm

Subsequently, the FLOW advances from B to C and D. The last values at D are maintained.

$N_{11} = Na - 10$ rpm $= 1900$ rpm $- 10$ rpm $= 1890$ rpm
$N_{12} = Na - 50$ rpm $= 1900$ rpm $- 50$ rpm $= 1850$ rpm
$N_{13} = Na - 70$ rpm $= 1900$ rpm $- 70$ rpm $= 1830$ rpm
$N_{14} = Na - 70$ rpm $= 1900$ rpm $- 70$ rpm $= 1830$ rpm Because the middle-speed operation is being Commanded at present, the FLOW branches to NO at the operating condition judging step E and also branches to NO at the subsequent Q step, the FLOW then leading to V. At the heavy-load judging step V, Ne of 1750 rpm is smaller than $N_{14}$ of 1830 rpm so that the true ($Ne < N_{14}$) is achieved. As a result, the FLOW branches to YES.

If the heavy load is detected, the FLOW gets to P without delay and the predetermined operation is immediately commanded.

After commanding the predetermined rotating operation, this FLOW becomes similar to the above-described FLOW (i) during charging the heavy load. However, the values of both Ne and Na are renewed every time until the govenor lever is returned to the position of the predetermined rotation. In response to the renewal of Na, the values of $N_{11}$, $N_{12}$, $N_{13}$ and $N_{14}$ are also renewed, respectively. The load judging conditions of F and K ar renewed.

Meanwhile, the values of the light and middle load elapsed times $T_{11}$ and $T_{12}$, which have been maintained on the last occasion, are cleared to zero as follows, at the point of time when he FLOW passes J and O for the first time. When the operation is performed under the light or middle load condition, the counters can start to count up from zero seconds.

$T_{11} = 3.02$ seconds → 0 seconds
$T_{12} = 3.00$ seconds → 0 seconds

3) Increase of the load during displacement of the govenor lever to the middle-speed operation position (retaining movement) (in the case where the load larger than the middle load is applied in the process of lowering the engine revolution number to that of the middle-speed operation when the engine load is small and the middle-load condition is continued)

FLOW (iv) START → A → B → C → D → E → Q → V → W → X → N → START
(vii) START → A → B → C → D → E → Q → V → W → X → U → START (iv) During displacement of the govern 2 and lever to the position of the middle-speed operation under the middle-load condition (as one example of state in the process of lowering the engine revolution number to that of the middle-speed operation, in the case where the engine revolution number is between the predetermined revolution number and the middle-speed operation command value)

Here, the FLOW proceeds quite similarly to the above-described FLOW 2. - 1) - (iv). In other words, the govenor lever is also at the intermediate position between the predetermined speed position and the low-speed position. Accordingly, Ne is 1920 rpm and Na is 1950 rpm. The values of Ne and Na at D are also the same.

| |
|---|
| $N_{11}$ = Na − 10 rpm = 1950 rpm − 10 rpm = 1940 rpm |
| $N_{12}$ = Na − 50 rpm = 1950 rpm − 50 rpm = 1900 rpm |
| $N_{13}$ = Na − 70 rpm = 1950 rpm − 70 rpm = 1880 rpm |
| $N_{14}$ = Na − 70 rpm = 1950 rpm − 70 rpm = 1880 rpm |

(vii) Charging of the middle load (when the middle load which is larger than the light load but smaller than the heavy load is charged in the process of lowering the engine revolution number to that of the middle-speed operation)

It is supposed that the load is charged in the last FLOW (iv) (during displacement of the govenor lever to the position of the low-speed operation) such that the engine revolution number Ne is smaller than $N_{13}$ and larger than $N_{14}$. Approximately 1890 rpm is selected as a value of the engine revolution number Ne. The respective values at the input processing step A are set as follows.

| |
|---|
| AEC SW = I stage |
| $A_{CCEL}$ = 2000 rpm |
| Ne = 1890 rpm |
| Na = 1950 rpm |

Subsequently, the FLOW advances from B to C and D. The values of the last FLOW (iv) are maintained at D.

Because the middle-speed operation is being commanded at present, the FLOW branches to NO at the operating condition judging step E and branches to NO at the subsequent Q step, the FLOW then leading to V. At the heavy-load judging step V, Ne of 1890 rpm is larger than $N_{14}$ of 1880 rpm so that the true ($Ne<N_{14}$) is not achieved.

At the operating condition judging step W, the FLOW branches YES because the engine operate during transition to the middle-speed operation. Further, at the middle-load judging step X, because Ne of 1890 rpm is smaller than $N_{12}$ of 1900 rpm, $Ne>N_{12}$ is not achieved. As a result, the FLOW branches to NO, arriving at the operating condition commanding step U where the command to retain the present position of the govenor lever is issued.

If the operation is brought into the middle-condition again after this load condition (that is, the retained condition) is continued for a little (for example, the engine revolution number Ne which has been 1890 rpm returns to 1920 rpm), the FLOW becomes similar to the FLOW (iv) at that point of time. At the middle-load judging step X, Ne of 1920 rpm is larger than $N_{12}$ of 1900 rpm, and accordingly, $Ne<N_{11}$ is achieved. The operation command changes from the condition retaining command to the middle-speed operation command N without delay so that the govenor lever is moved to the position of the middle-speed operation again.

A supplementary explanation concerning the retaining function will be given here. The middle-load judging step X acts to branch the operation command into the following two commands in association with the load judgement at the previous heavy-load judging step V.

| | |
|---|---|
| (a) $Ne > N_{12}$ | (the middle load condition) ⟶ a command for performing the middle-speed operation |
| (b) $N_{12} > Ne > N_{14}$ | (the intermediate condition between the heavy and middle load conditions) ⟶ a command for retaining the present position |

More specifically, in view of operability of the hydraulic shovel, because a certain load is charged though the load is not so heavy that the engine revolution number should return to the predetermined revolution number (high speed), the present position of the govenor lever is retained without reducing the revolution number to that of the middle-speed operation. A supplying rate of the fuel is changed by displacing the position of the govenor lever. Generally, the fuel supplying rate is changed in accordance with the load even in case of retaining the position of the govenor lever. In this case, therefore, the govenor lever may be operated so that the fuel supplying rate at that time may be maintained without retaining the present position of the govenor lever.

Figure 2A:
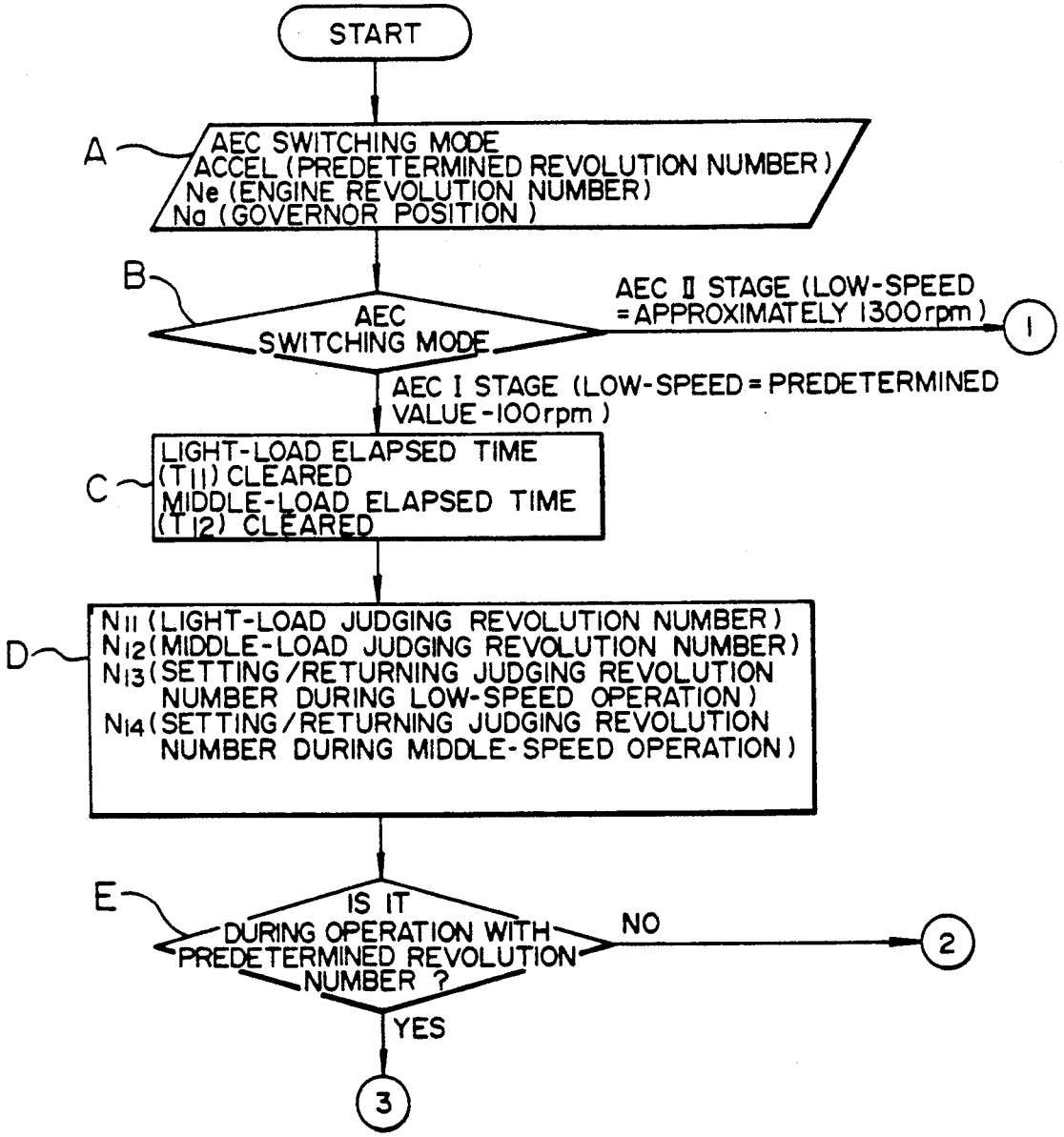
FIGS. 2A and 2B are views illustrating a part of a flowchart of a first embodiment of a method for controlling a hydraulic pump driving engine according to the invention.
Figure 2B:
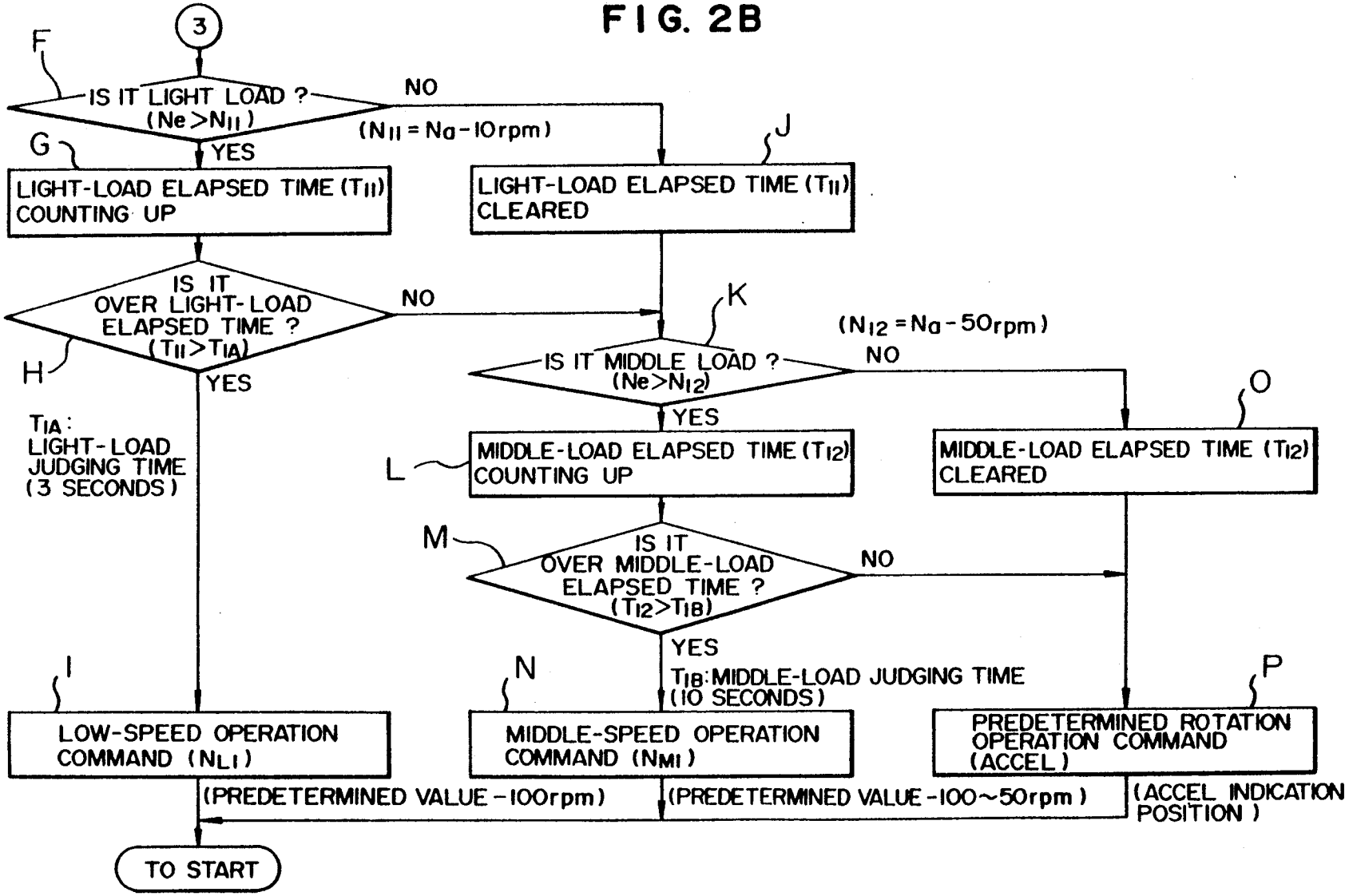
Figure 3:
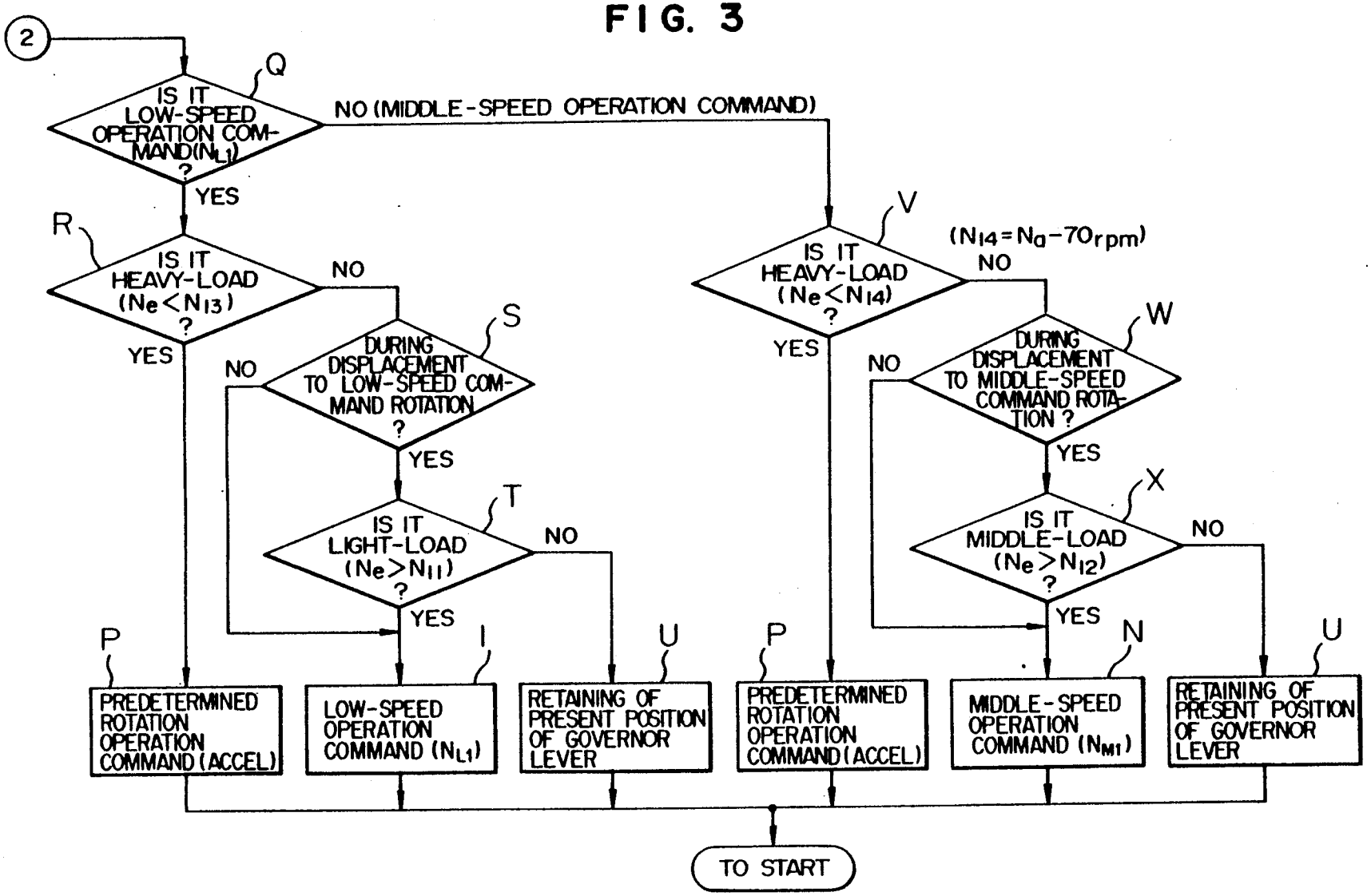
FIG. 3 is a view illustrating another part of the flowchart of the first embodiment.
Figure 4A:
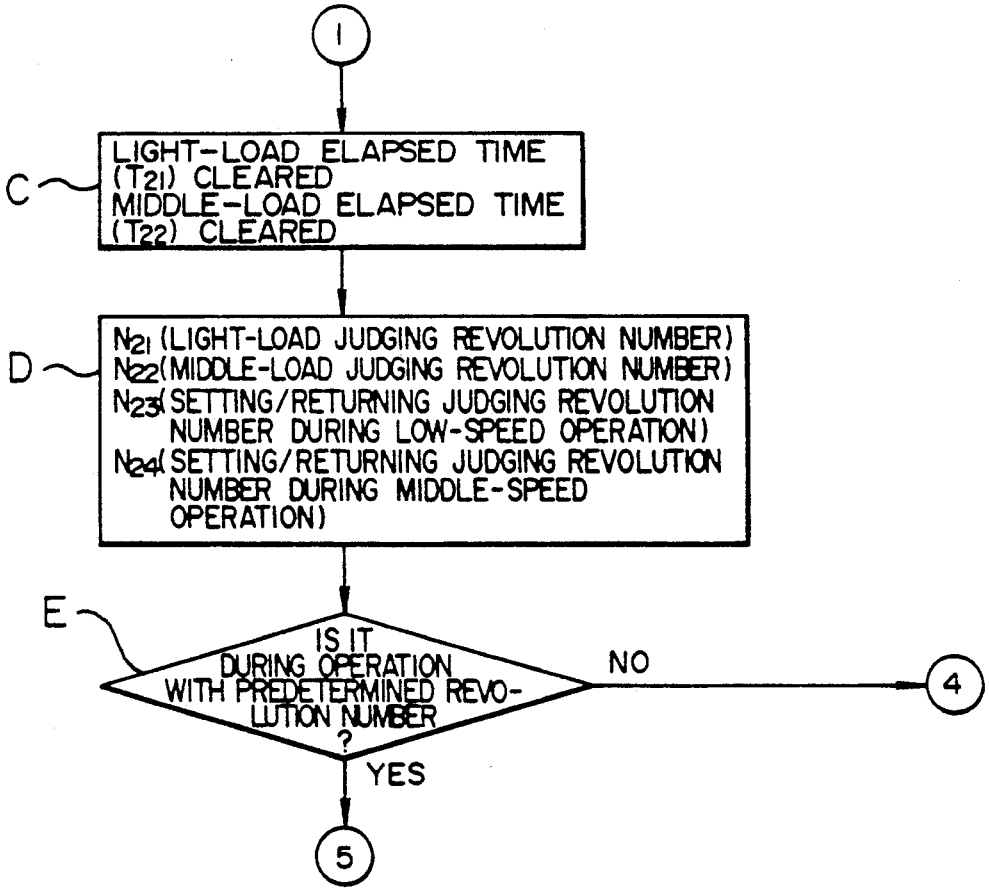
FIGS. 4A and 4B are views illustrating another part of the flowchart of the first embodiment.
Figure 4B:
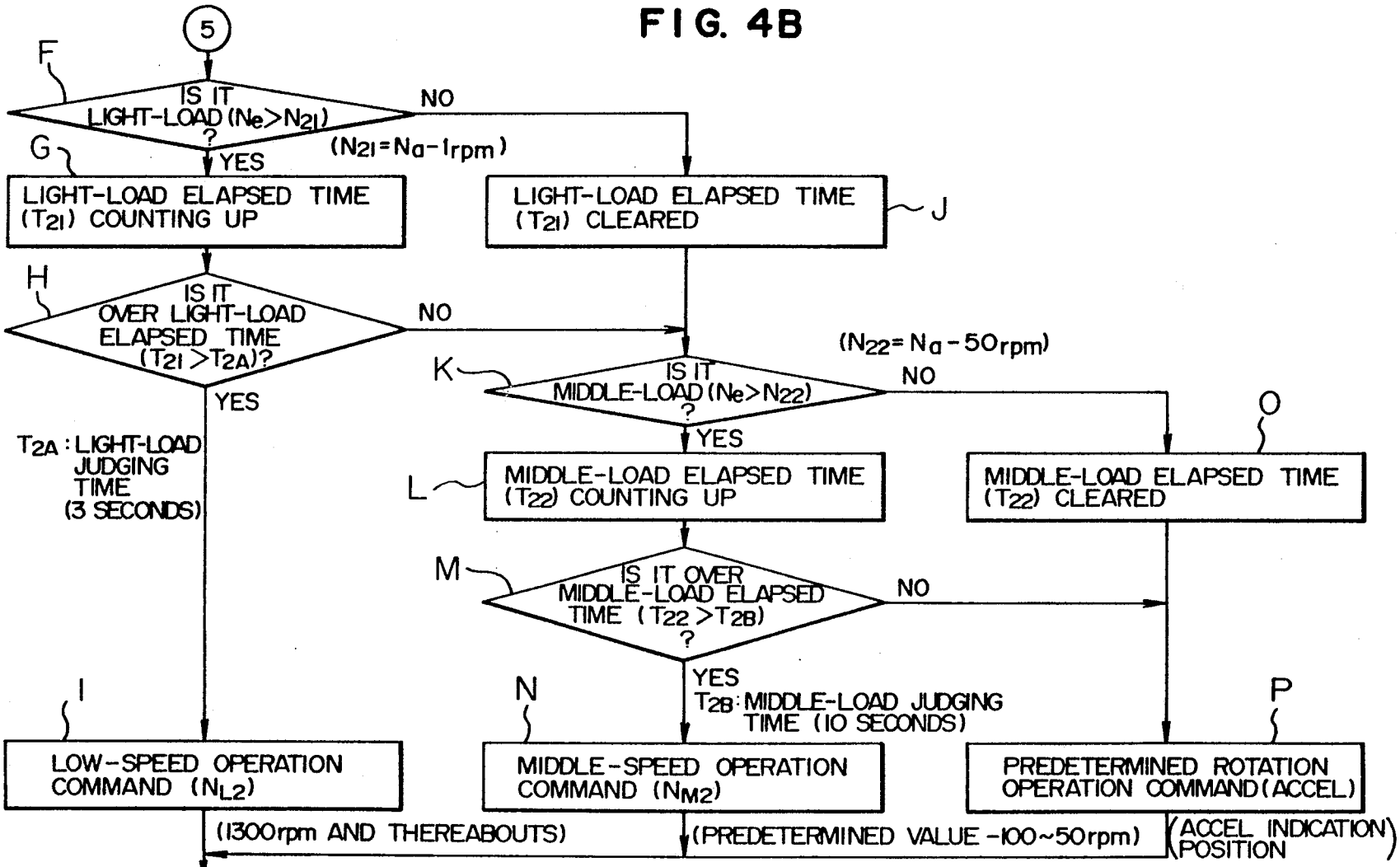
Figure 5:
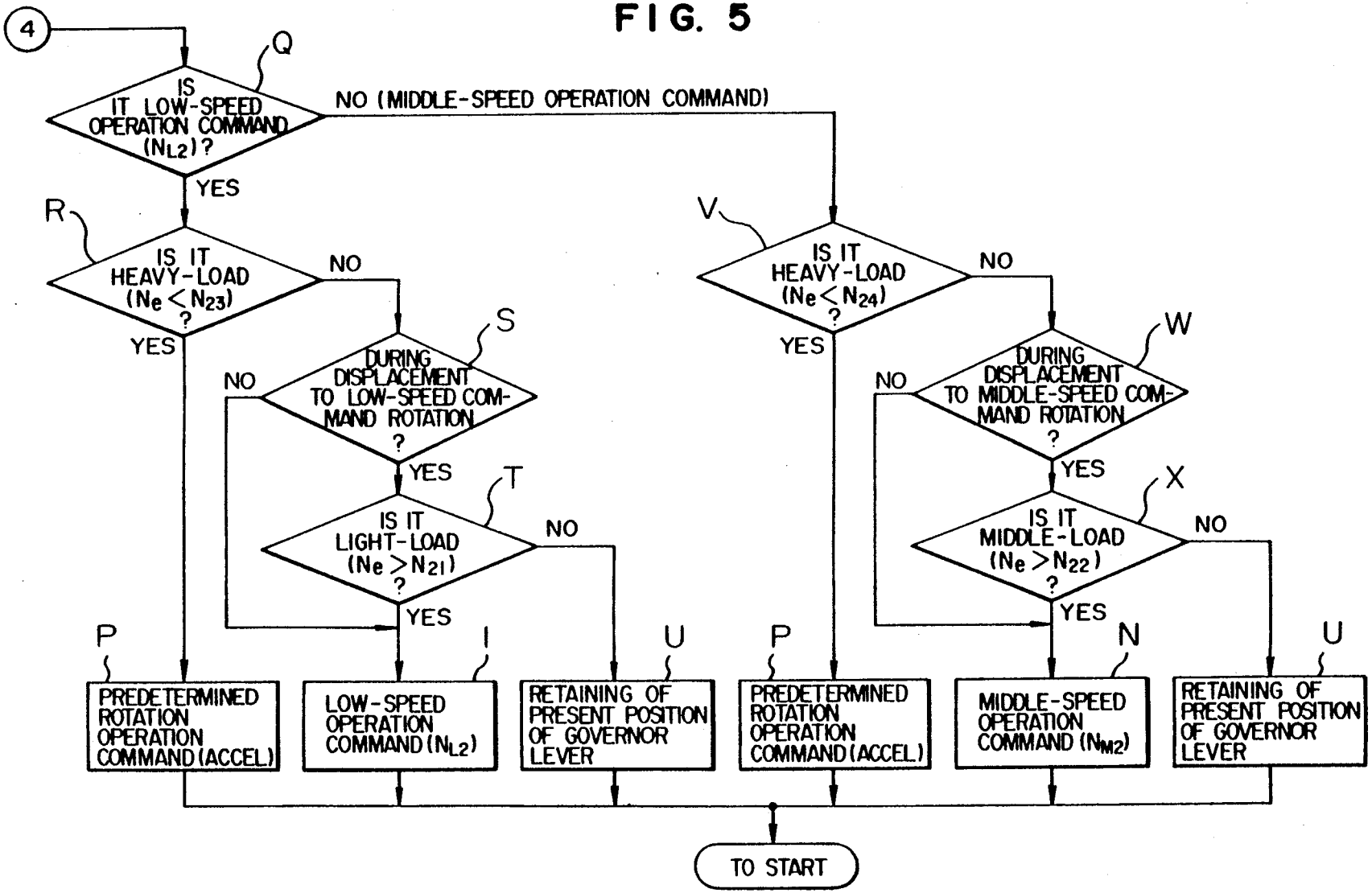
FIG. 5 is a view illustrating another part of the flowchart of the first embodiment.
Figure 6:
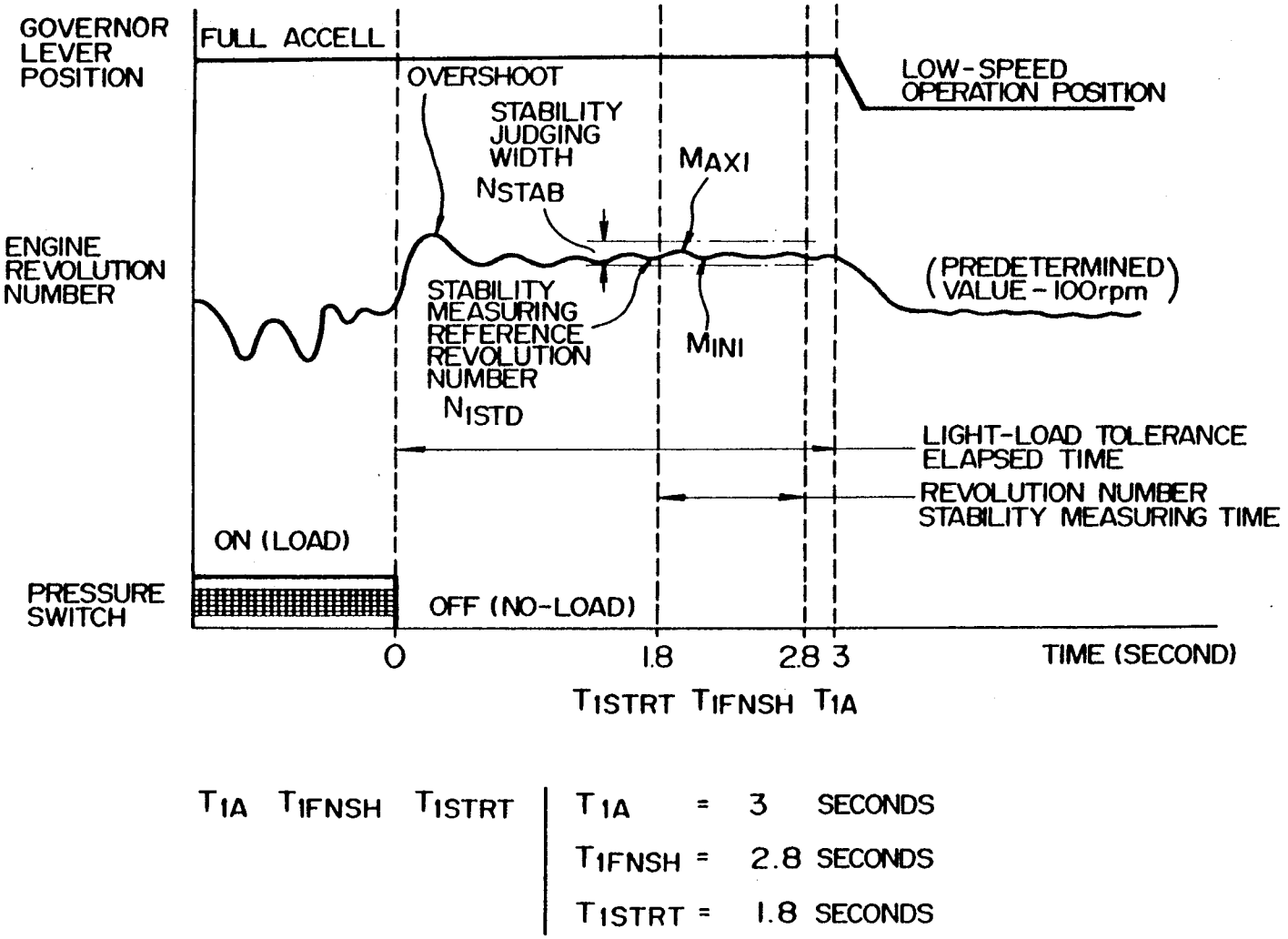
FIG. 6 is a diagram for explanation of one embodiment of the controlling method for the hydraulic pump driving engine according to the invention.
Figure 7A:
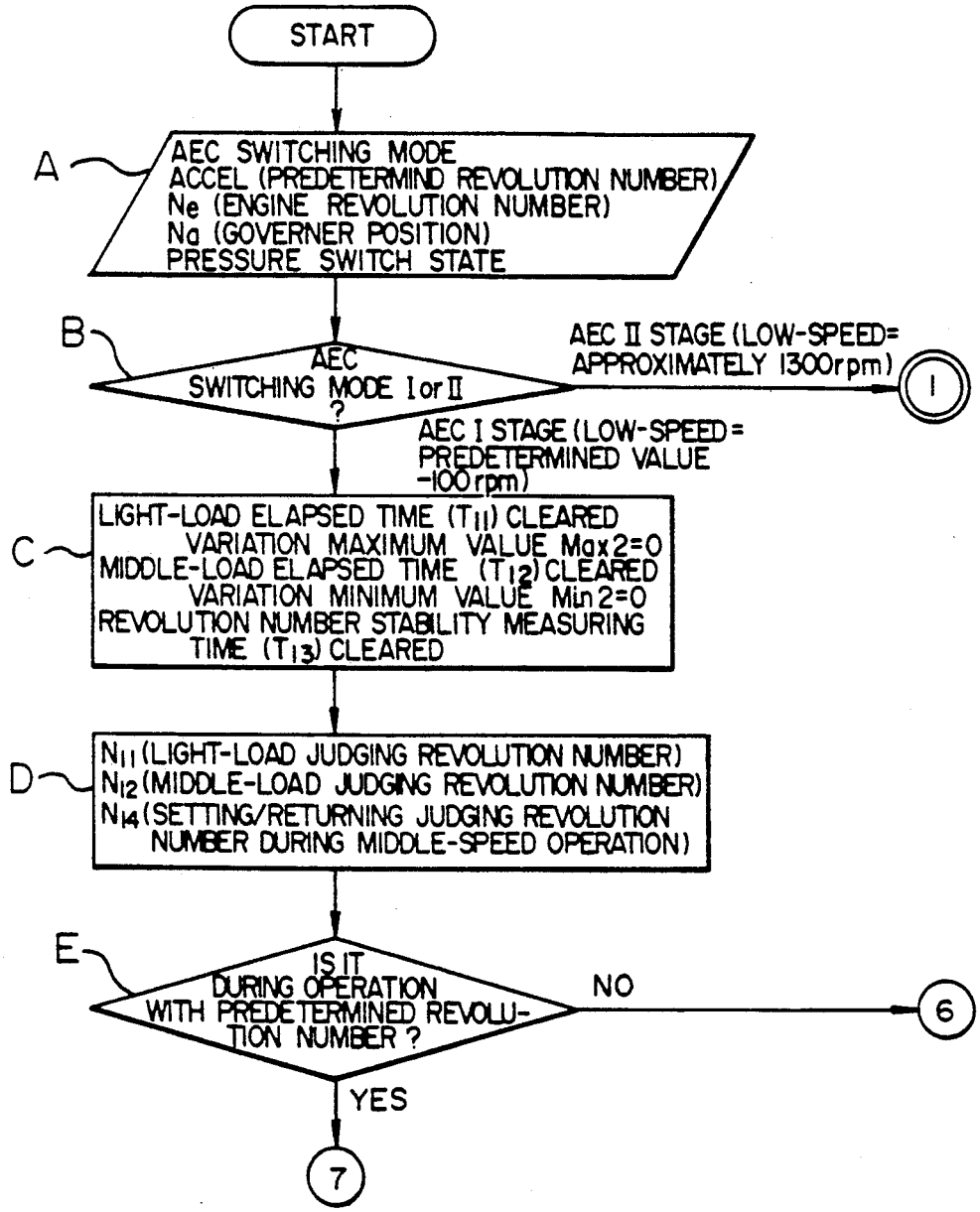
FIGS. 7A and 7B are views showing a part of a flowchart of a second embodiment of the method for controlling a hydraulic pump driving engine according to the invention.
Figure 7B:
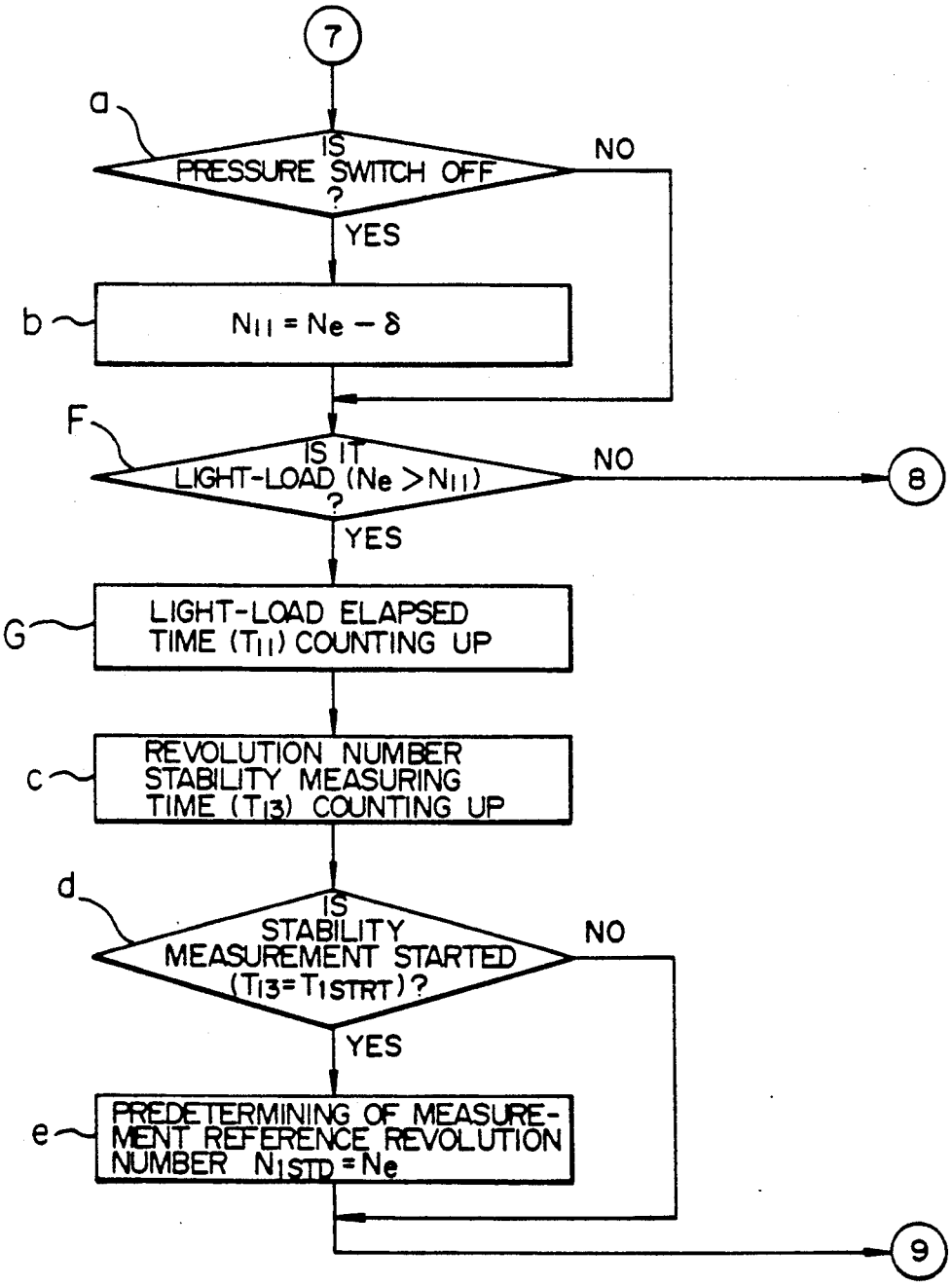
Figure 8A:
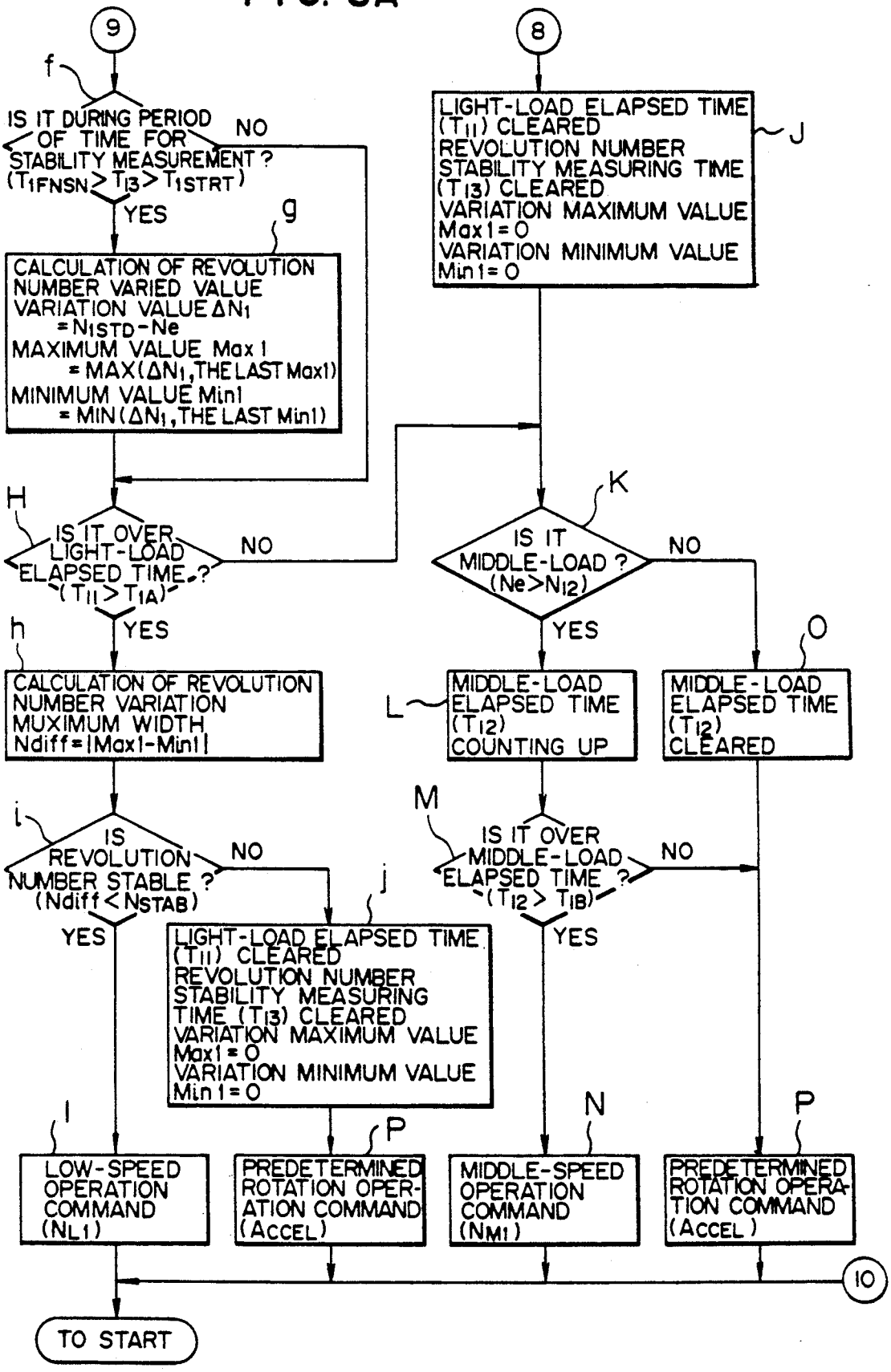
FIGS. 8A and 8B are views depicting another part of the flowchart of the second embodiment.
Figure 8B:
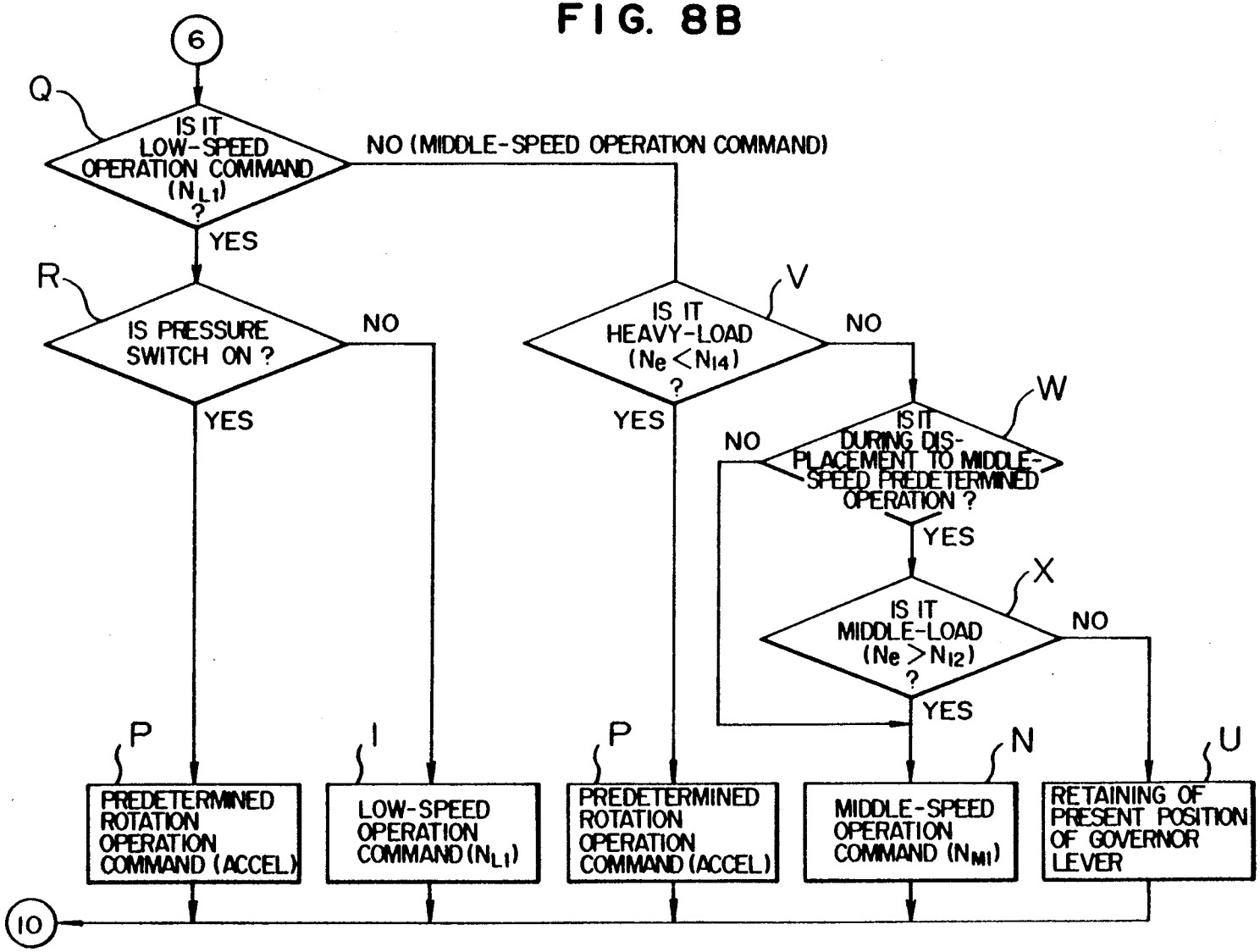

FIGS. 4A, 4B and 5 show a flow chart for AEC II stage in which $NL_2$ is about 1300 rpm and whose control is similar to the control flow shown in FIGS. 2A, 2B and 3.

As one embodiment of a method of judging the no-load (neutral) condition, there will be shown a method in which both of the engine revolution number and a neutral detection pressure switch signal are utilized. In the following explanation of this embodiment shown in FIGS. 7A, 7B, 8A and 8B, portions indicated by alphabets correspond to steps in the flowcharts of FIGS. 7A, 7B, 8A and 8B.

Generally, in a hydraulic shovel during actual operation such as digging, the number of revolutions of the engine varies in accordance with the variation of the load. On the other hand, under the no-load (neutral) condition, the engine revolution number is stably set at a certain value, exclusive of an overshoot output period immediately after beginning of the load is eliminated. Succeedingly, measurement of the variation amount of the engine revolution number can be one condition for judging the no-load condition.

More specifically, a logical multiplier of the variation value of the engine revolution number (stable judgment result), the neutral detection pressure switch signal and the light-load elapsed time judging result is used to thereby command the low-speed operation.

Moreover, according to this method, it is possible to prevent the low-speed operation command from being issued carelessly when the engine revolution number is unstable owing to the load variation even if a pressure switch trouble (such as breaking of wire) is caused during charging the load, so that the operability of the hydraulic shovel is not deteriorated.

1. FLOW when the AEC I stage is selected

| | | |
|---|---|---|
| Operator Selecting Condition: | | AEC = I stage |
| | | Accel Position = Full |
| | | Accel ($A_{CCEL}$ = 200 rpm) |
| | 1. | Low-speed Operation Command |
| | | 1) heavy load → low load |
| FLOW | (i) | START → A → B → C → D → E → a → F → J K → O → P → START |
| | (ii) | START → A → B → C → D → E → a → b → F → G → c → d → f → H → K → L → M → P → START |
| | (iii) | START → A → B → C → D → E → a → b → F → G → c → d → e → f → H → K → L → M → P → START |
| | (iv) | START → A → B → C → D → E → a → b → F → G → c → d → f → g → H → K → L → M → P → START |
| | (v) | START → A → B → C → D → E → a → b → F → G → c → d → f → H → K → L → M → P → START |
| | (vi) | START → A → B → C → D → E → a → b → F → G → c → d → f → H → h → i → I → START |

(i) Heavy-load Condition

This FLOW is quite similar to the FLOWs described above. However, at the signal input processing step A, the pressure switch signal ON (during charging the load) or OFF (with no load) is input. Since the operation is performed under the heavy-load condition, ON is detected at the pressure switch signal judging step a so that the FLOW bypasses b to branch to F, differently from the aforesaid FLOWs.

By bypassing b (that is, during charging the load), such value of $N_{11}$ as to be determined by a govenor lever position signal at D is maintained to be used in the subsequent light-load judging step F as mentioned above.

(ii) No-load Transition Condition

At the signal input step A, the engine revolution number Ne varies while the pressure switch signal changes from ON to OFF. The FLOW advances from B to C, D, E and a, and it then branches to YES at the a step since the pressure switch signal is OFF. At the arithmetic step b, the light-load judging revolution number is rewritten such that $N_{11}=Ne-\delta$. At the light-load judging step F, $Ne>N_{11}$ is kept by the rewriting of $N_{11}$ and the FLOW branches to YES.

At the counter steps G and C, counters count up respectively so that the light-load elapsed time $T_{11}$ and the revolution number stable measurement time $T_{13}$ become 0.02 seconds. A counter at d has not counted up to a stable measurement start time yet. That is to say, because $T_{13}$ which is 0.02 seconds is not equal to $T_{1STRT}$ which is 1.8 seconds, the FLOW branches to NO, then leading to f. At f, $T_{1STRT}$ of 1.8 seconds is larger than $T_{13}$ of 0.02 seconds, and accordingly, the true is not achieved. The FLOW branches to H.

The FLOW branches to K, because $T_{11}=0.02$ seconds$<T_{1A}=3$ seconds, and it branches to L because of the light load. At L, a counter counts up such that $T_{12}$ is 0.02 seconds, whereas $T_{12}$ of 0.02 second is smaller than $T_{1B}$ which is 10 seconds at M so that the true ($T_{12}>T_{1B}$) is not achieved. Therefore, the predetermined rotation command is still maintained at P.

(iii) Maintenance of the no-load condition ($T_{13}=T_{1STRT}$)

In this FLOW, the condition occurring after 1.8 seconds ($T_{13}=T_{1STRT}$) have been elapsed after the load is eliminated in the state of commanding the no-load predetermined operation will be explained. The FLOW proceeds from A to B, C, D, E, a, b, F and G. At G and c, $T_{11}$ and $T_{13}$ both become 1.8 seconds. Because $T_{13}=T_{1STRT}=1.8$ seconds, the FLOW branches to YES at the revolution number stable measurement start time judging step d. Then, at the measurement reference revolution number setting step e, the measurement reference revolution number $N_{1STD}$ is predetermined to be 2000 rpm which is equal to Ne. The FLOW branches to H because $T_{13}>T_{1STRT}$ is not achieved, and it subsequently advances from H to K, L, M and P, thereby maintaining the predetermined rotation command.

(iv) Maintenance of the no-load condition—Period of the stable measurement time ($T_{1FNSH}<T_{13}<T_{1STRT}$)

In this FLOW, a process in which varied values of the revolution number are calculated and its maximum and minimum values are renewed will be described.

At present, it is supposed that $T_{11}=T_{12}=T_{13}=2.4$ seconds. The FLOW advances from A to B, C, D, E, a, b, F, G, c and d successively. At d, the FLOW branches to NO because $T_{13}$ of 2.4 seconds is not equal to $T_{1STRT}$ of 1.8 seconds (in other words, the measurement reference revolution number is not renewed and $N_{1STD}$ of 2000 rpm is maintained), then branching to f. At f, since $T_{13}$ is smaller than $T_{1FNSH}$ which is 2.8 seconds and larger than $T_{1STRT}$ which is 1.8 seconds, the FLOW branches to q for calculating the varied values of the revolution number.

Here, a difference between the previously determined measurement reference revolution number $N_{1STD}$ (=2000 rpm) and an actual revolution number at present is obtained to be compared with the past varied maximum and minimum values during a period of the present measuring time. The maximum or minimum values are renewed if necessary in such a manner that the memorized values are always the newest. At H, because $T_{11}=2.4$ seconds$<T_{1A}=3$ seconds, the FLOW branches to K, and subsequently, it proceeds from K to L, M and P.

(v) Maintenance of the no-load condition—After the stable measurement time is elapsed ($T_{1A}>T_{11}=T_{13}>T_{1FNSH}$)

A state obtained before a light-load tolerance time has not elapsed after the revolution number stable measurement time was elapsed will be described. The present count number is such that $T_{11}=T_{13}=2.9$ seconds. The FLOW advances from A to B, C, D, E, a, b, F, G, c, d and f, where it branches to H and the revolution number variation is not calculated. This is because $T_{1STRT}=1.8$ seconds, $T_{1FNSH}=2.8$ second and $T_{13}=2.9$ seconds and therefore, $T_{13}>T_{1FNSH}$ and it is not during the period of time for stability measurement. At H, because it is before the light-load tolerance elapsed time ($T_{1A}$), the FLOW branches to K, L, M and P. The engine keeps to rotate at the predetermined speed.

(vi) Maintenance of the no-load condition—After the light-load tolerance time has elapsed ($T_{11}=T_{13}>T_{1A}$)

In this FLOW, a condition such that the low-speed operation command is issued for the first time will be explained. The elapsed time $T_{11}$ is equal to $T_{13}$ which is 3.02 seconds. The FLOW proceeds from A to B, C, D, E, a, b, F G, c, d, f and H because $T_{13}=3.02$ seconds and $T_{13}>T_{1FNSH}$. In the light-load tolerance elapsed time judging step H, because $T_{11}=3.02$ seconds$>T_{1A}=3$ seconds, the FLOW branches to YES, then arriving at h. At h, the maximum and minimum varied values ($M_{AXI}$, $M_{INI}$) which have been sorted in the previous revolution number varied value arithmetic step are used to calculate a revolution number varied maximum range $N_{DIFF}$. Then, at the revolution number stable judging step , a stability judgement is made. If the revolution number varied maximum range $N_{DIFF}$ is smaller than a judgement standard value $N_{STAB}$, the condition is regarded as stable and the FLOW reaches the low-speed operation command step I.

In the case where $N_{DIFF}<N_{STAB}$ is not achieved, it is considered that the load is charged. The FLOW branches to j and arrives at P after the light-load elapsed time and revolution number stability measuring time counters $T_{11}$ and $T_{13}$ and the revolution number varied maximum and minimum values $M_{AXI}$ and $M_{INI}$ are cleared to zero, whereby the predetermined rotation operation command is continued to be issued. In this case, the FLOW returns to the aforesaid one (ii) and the stability judgement is repeated again.

1) Charging of the heavy load during the low-speed operation with no load

Slightly differently from the above FLOW, this FLOW advances from A to B, C, D, E, Q, R and P. More particularly, when any load is charged, irrespective of the largeness of the load, during the low-speed operation with no load (that is, just when the pressure switch becomes ON), the low-speed operation returns to the predetermined rotation operation unconditionally.

In the present invention, instead of decreasing the supplying rate of the fuel to the engine to thereby reduce the number of revolutions of the engine when the load of the engine is less than a first predetermined value or when such fact that the engine load is less than the first predetermined value, continues for a first certain period of time, or in combination with these conditions through a logical sum or logical multiply with conditions described below. When a fact that a command for stopping the operation of all the hydraulic actuators is input into the hydraulic valves 3 and 4 which are provided between the hydraulic pumps and the hydraulic actuators for controlling the hydraulic actuators to operate or stop, is detected from an output of the pressure gauge 11 and the command is retained more than a second certain period of time (this time period may be equal to the first certain period of time), the supply rate of the fuel to the engine may be decreased to thereby reduce the revolution number of the engine. Further, in combination with the above conditions through the logical multiplier or logical sum, when a fact such that a variation rate of the engine load is less than a predetermined range, continues more than a third certain period of time, the supplying rate of the fuel to the engine may be decreased to thereby reduce the revolution number of the engine. Moreover, after thus reducing the engine revolution number, in combination, with the above condition through the logical multiplier or logical sum with the following condition, when a fact that the command for operating at least one hydraulic actuator is input into the hydraulic valves 2 and 3, is detected from the output of the pressure gauge 11 and the command for operating at least one hydraulic actuator is issued, the supplying rate of the fuel to the engine is increased to raise the engine revolution number. It is also possible to measure the engine load from an actual output torque of the engine which is obtained from a torque sensor provided on an output shaft of the engine. It is further possible to measure the engine load from a hydraulic pump output flow rate to be output from a flow rate sensor provided on a pipe for feeding pressurized fluid to the actuators. In the case where a fuel supplying rate reduction inhibiting command is further input and the fuel supplying rate reduction inhibiting command is issued, even if the engine load for driving the hydraulic pumps to generate the hydraulic pressure for operating the hydraulic actuators is less than the first predetermined value, or even if the command for stopping the operation of all the hydraulic actuators is input to the hydraulic valves and the command is retained more than the certain period of time, it is unnecessary to decrease the supplying rate of the fuel to the engine.

What is claimed is:

1. A method for controlling an engine for driving a hydraulic pump to supply to pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the load of the engine for driving the hydraulic pump is measured from a difference between an actual output rotational speed of the engine and an output rotational speed of the engine which is obtainable when an action of the hydraulic actuator is stopped.

2. A method according to claim 1, wherein the fuel flow is decreased in the engine output decreasing step, when the load of the engine is less than a second level.

3. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the fuel flow is decreased in the engine output decreasing step, when a hydraulic valve arranged between the hydraulic pump and the hydraulic actuator to control an action of the hydraulic actuator is operated to step the action of the hydraulic actuator.

4. A method according to claim 3, wherein the fuel flow is decreased in the engine output decreasing step, when the hydraulic valve arranged between the hydraulic pump and the hydraulic actuator to control the action of the hydraulic actuator is operated to step the action of the hydraulic actuator during a predetermined time.

5. A method according to claim 3, wherein the fuel flow is decreased in the engine output decreasing step, when the hydraulic valve arranged between the hydraulic pump and the hydraulic actuator to control the action of the hydraulic actuator is operated to step the action of the hydraulic actuator and a range in which the load of the engine varies is kept narrower than a predetermined degree during a predetermined time.

6. A method according to claim 3, wherein the fuel flow is decreased in the engine output decreasing step, when the hydraulic valve arranged between the hydraulic pump and the hydraulic actuator to control the action of the hydraulic actuator is operated to stop the action of the hydraulic actuator and the load of the engine is less than the second level and a range in which the load of the engine varies is kept narrower than a predetermined degree during a predetermined time.

7. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the load of the engine for driving the hydraulic pump calculated based on an actual output torque of the engine.

8. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the load of the engine for driving the hydraulic pump calculated based on an actual flow rate of the pressurized fluid supplied to the actuator.

9. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the fuel flow is not decreased when prevention of the decrease of the fuel flow is ordered.

10. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein fuel flow is increased to increase the output rotational speed of the engine, when the load of the engine for driving the hydraulic pump is more than the first level and a hydraulic valve arranged between the hydraulic pump and the hydraulic actuator to control an action of the hydraulic actuator is operated to generate the action of the hydraulic actuator after the engine output decreasing step.

11. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the load of the engine for driving the hydraulic pump is calculated from an engine speed and governor lever position.

12. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the load of the engine for driving the hydraulic pump is calculated from an engine speed and a neutral detection pressure switch.

13. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the fuel flow is decreased in the engine output decreasing step, when the load of the engine is kept less than a second level during a predetermined time.

14. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the fuel flow is decreased in the engine output decreasing step, when the load of the engine is less than a second level and a hydraulic valve arranged between the hydraulic pump and the hydraulic actuator to control an action of the hydraulic actuator is operated to stop the action of the hydraulic actuator.

15. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the fuel flow is decreased in the engine output decreasing step, when the load of the engine is less than a second level and a hydraulic valve arranged between the hydraulic pump and the hydraulic actuator to control an action of the hydraulic actuator is operated to stop the action of the hydraulic actuator during a predetermined time.

16. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the fuel flow is decreased gradually in the engine output decreasing step, when the load of the engine is less than a second level and the decrease of the fuel flow is stopped when the load of the engine is not less than the second level and is less than the first level.

17. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the fuel flow is decreased in the engine output decreasing step, when the load of the engine is kept less than a second level, the second level being less than the first level.

18. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the fuel flow is decreased in the engine output decreasing step, when the load of the engine is less than a second level, and wherein the fuel flow is decreased, also when a hydraulic valve arranged between the hydraulic pump and the hydraulic actuator to control an action of the hydraulic actuator is operated to stop the action of the hydraulic actuator.

19. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the fuel flow is decreased in the engine output decreasing step, when the load of the engine is less than a second level, and wherein the fuel flow is decreased, also when a hydraulic valve arranged between the hydraulic pump and the hydraulic actuator to control an action of the hydraulic actuator is operated to stop the action of the hydraulic actuator during a predetermined time.

20. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the fuel flow is decreased in the engine output decreasing step, when the load of the engine is less than a second level, and wherein the fuel flow is increased, also when a hydraulic valve arranged between the hydraulic pump and the hydraulic actuator to control an action of the hydraulic actuator is operated to generate the action of the hydraulic actuator.

21. A method for controlling an engine for driving a hydraulic pump to supply a pressurized fluid to at least one hydraulic actuator in construction equipment, comprising the steps of:

engine output decreasing step for decreasing a fuel flow supplied to the engine so that an output rotational speed of the engine is decreased to decrease an excess output of the engine, and engine output increasing step for increasing the fuel flow to increase the output rotational speed of the engine when an actual condition of the load of the engine driving the hydraulic pump is more than a first level after the engine output decreasing step, and wherein the fuel flow is decreased in the engine output decreasing step, when the load of the engine is less than a second level, and wherein the fuel flow is decreased when the load of the engine is less than the second level and a range in which the load of the engine varies is kept narrower than a predetermined degree during a predetermined time.

* * * * *